US006375185B1

(12) United States Patent
Lin

(10) Patent No.: US 6,375,185 B1
(45) Date of Patent: Apr. 23, 2002

(54) PAPER CURRENCY RECEIVING CONTROL ASSEMBLY FOR CURRENCY-COIN EXCHANGE MACHINE

(75) Inventor: Tung-Ying Lin, Taipei (TW)

(73) Assignee: Gamemax Corporation, Taipei (TW)

( * ) Notice: Subject to any disclaimer, the term of this patent is extended or adjusted under 35 U.S.C. 154(b) by 0 days.

(21) Appl. No.: 09/692,444

(22) Filed: Oct. 20, 2000

(51) Int. Cl.[7] ..... B65H 29/38
(52) U.S. Cl. ..... 271/177; 271/180
(58) Field of Search ..... 271/177, 180, 271/181, 207

(56) References Cited

U.S. PATENT DOCUMENTS 4,809,967 A * 3/1989 Kondo ..... 271/181
5,505,439 A * 4/1996 Watabe et al. ..... 271/177
5,509,646 A * 4/1996 Chang ..... 271/177
5,564,545 A * 10/1996 Suzuki ..... 194/206
6,217,021 B1 * 4/2001 Ito et al. ..... 217/177
6,241,240 B1 * 6/2001 Bukhman ..... 271/214

* cited by examiner

*Primary Examiner*—David H. Bollinger
(74) *Attorney, Agent, or Firm*—Bacon & Thomas, PLLC

(57) ABSTRACT

A paper currency receiving control assembly for currency-coin exchanging machine is constructed to include a paper currency receiving unit adapted to receive paper money, a paper currency delivery unit adapted to delivery paper money to the paper currency receiving unit, and a control unit adapted to control the operation of the paper currency delivery unit, the control unit having a control circuit board adapted to control the operation of the paper currency delivery unit, a first solenoid switch adapted to turn on the control circuit board, a second solenoid switch adapted to turn off the control circuit board, a fixed magnetic member, which drives the first solenoid switch to turn on the control circuit board, and movable magnetic member, which drives the second solenoid switch to turn off the control circuit board when the received amount of paper currency reaches the set range.

8 Claims, 6 Drawing Sheets

PAPER CURRENCY RECEIVING CONTROL ASSEMBLY FOR CURRENCY-COIN EXCHANGE MACHINE

BACKGROUND OF THE INVENTION

The present invention relates to a paper currency receiving control assembly for currency-coin exchanging machine and, more particularly, to such a paper currency receiving control assembly, which uses a magnetic member to control a solenoid switch to turn off the machine when the amount of the received paper currency reaches the set level.

Regular vending machines include two types, one that accepts coins only, and the other that accepts paper money. In order to help clients exchange paper money, a currency-coin exchanging machine may be provided nearby coin-slot type vending machines. In a currency-coin exchanging machine, counter means, photoelectric switch means or micro-switch means may be installed to detect the amount of accumulated paper money, and to turn off the machine when the amount of accumulated paper money reaches the designed level. The use of counter means, photoelectric switch means, or micro-switch means has drawbacks. The main drawback of counter means is the complicated design of the related loop and its maintenance work. The main drawback of photoelectric switch means is its high cost and high possibility of false action. The main drawback of micro-switch means is its short service life. Micro-switch tends to be damaged a short period of time after its use.

SUMMARY OF THE INVENTION

The invention has been accomplished to provide a paper currency receiving control assembly for currency-coin exchanging machine, which eliminates the aforesaid drawbacks. According to one aspect of the present invention, the paper currency receiving control assembly for currency-coin exchanging machine comprises a paper currency receiving unit adapted to receive paper money, a paper currency delivery unit adapted to delivery paper money to the paper currency receiving unit, and a control unit adapted to control the operation of the paper currency delivery unit, the control unit having a control circuit board adapted to control the operation of the paper currency delivery unit, a first solenoid switch adapted to turn on the control circuit board, a second solenoid switch adapted to turn off the control circuit board, a fixed magnetic member, which drives the first solenoid switch to turn on the control circuit board, and movable magnetic member, which drives the second solenoid switch to turn off the control circuit board when the received amount of paper currency reaches the set range. According to another aspect of the present invention, the movable magnetic member is mounted on a pressure board, which is supported on spring means inside the currency box of the paper currency receiving unit and adapted to receive paper money being delivered from said paper currency delivery unit.

DETAILED DESCRIPTION OF THE PREFERRED EMBODIMENT

Figure 1:
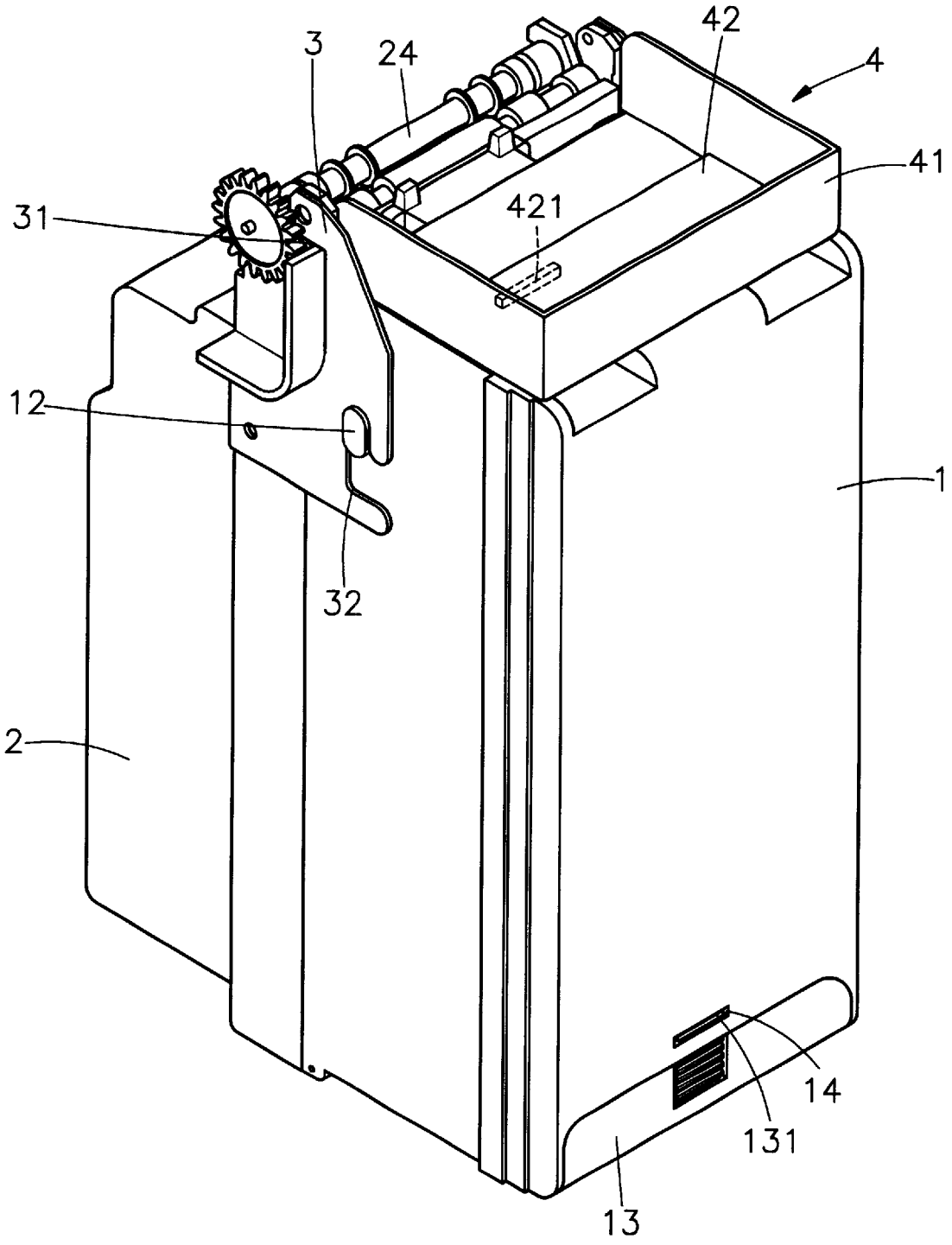
FIG. 1 is an elevational view of a paper currency receiving control assembly for currency-coin exchanging machine according to the present invention.
Figure 2:
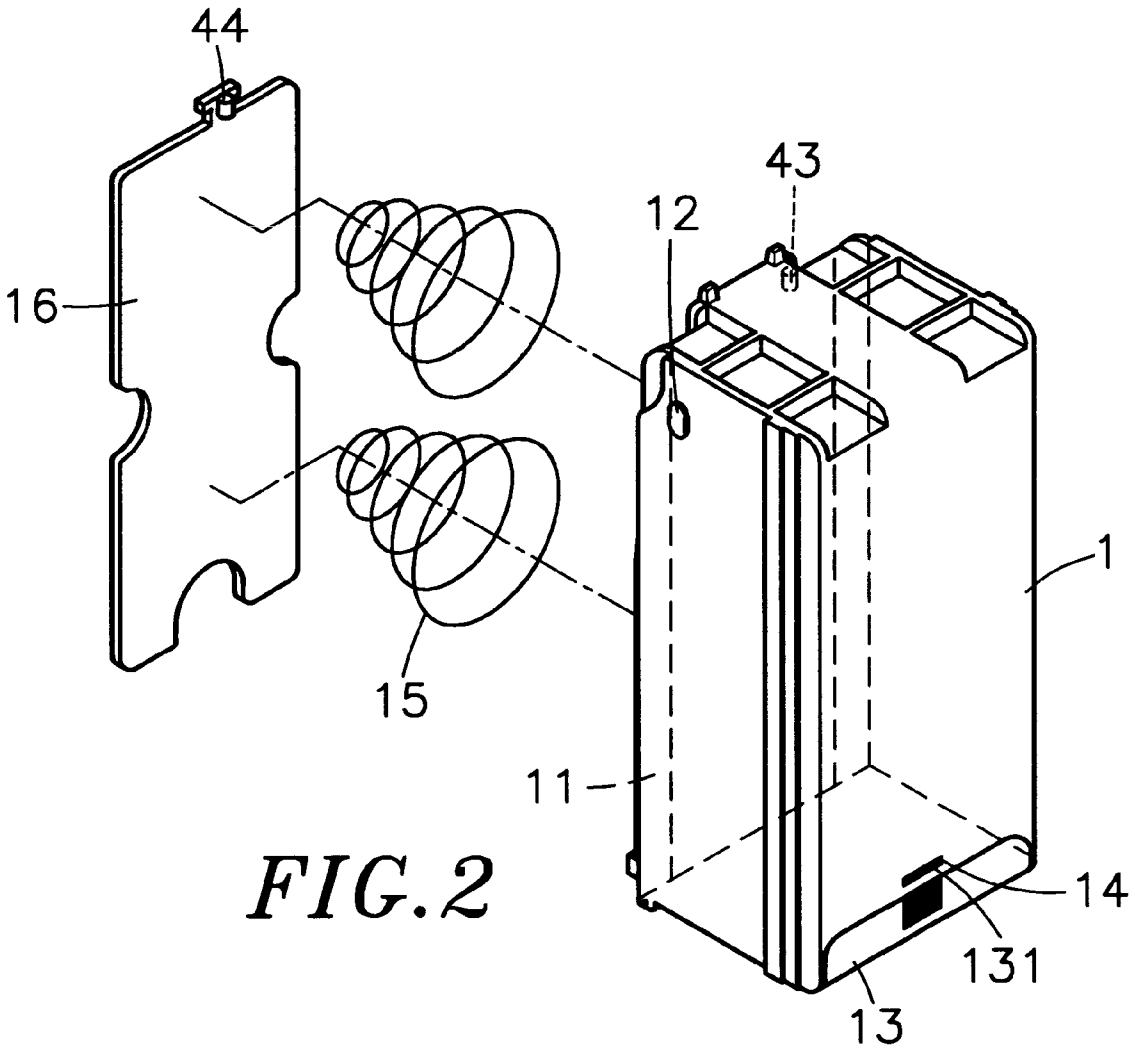
FIG. 2 is an exploded view of the currency box for the paper currency receiving control assembly according to the present invention.
Figure 3:
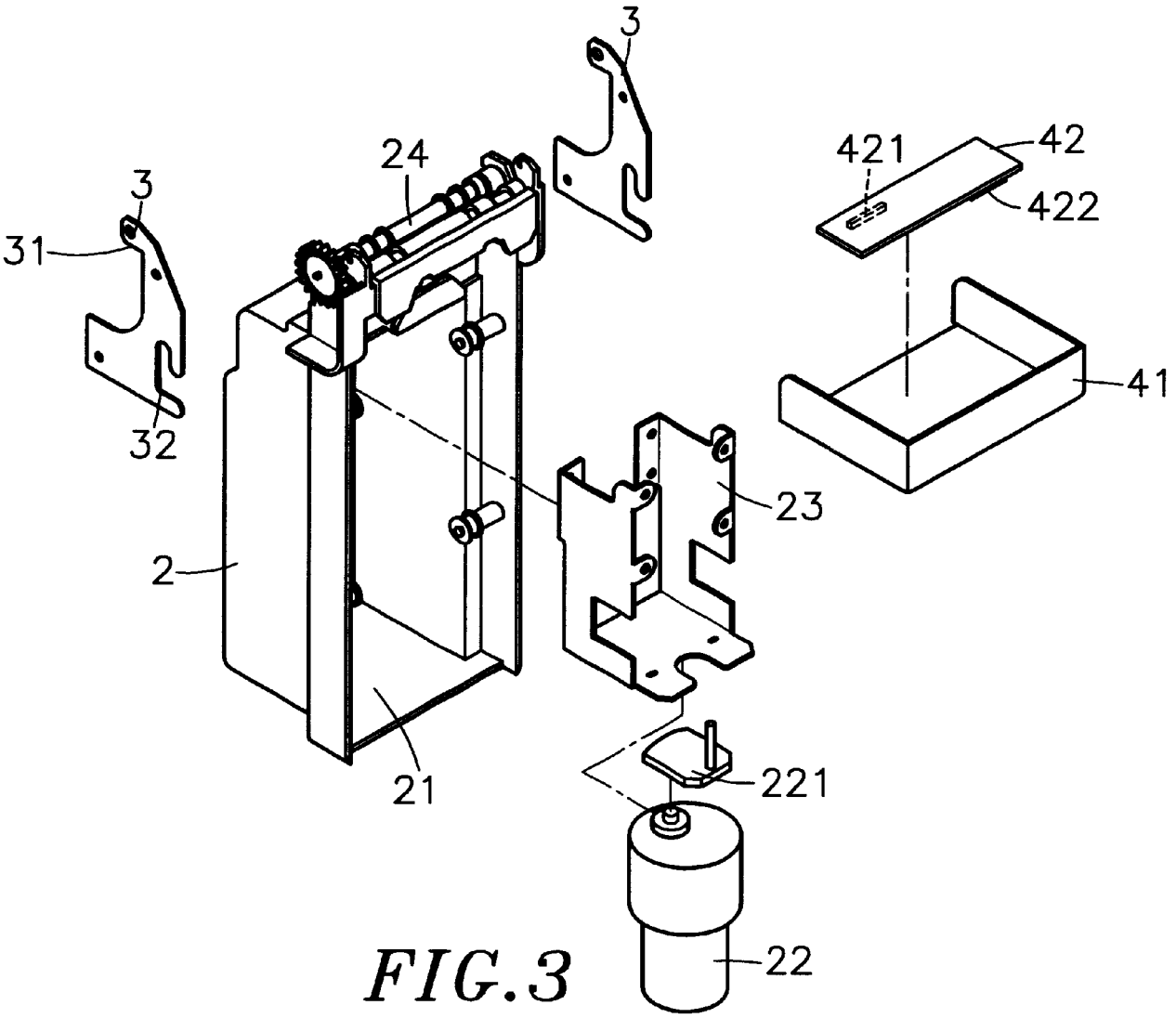
FIG. 3 is an exploded view of the casing, locating plates and control unit of the paper currency receiving control assembly according to the present invention.
Figure 4:
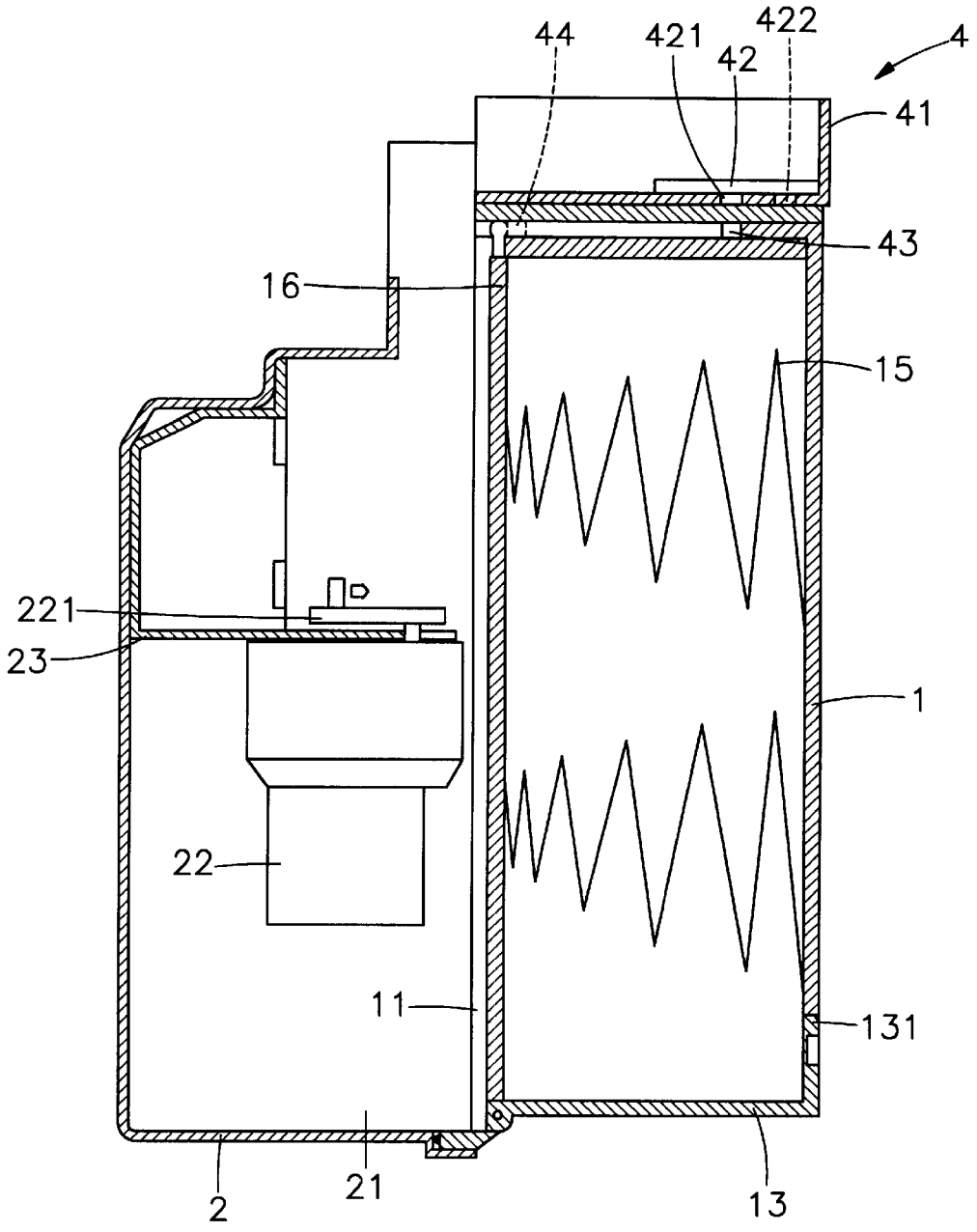
FIG. 4 is a side view in section of the paper currency receiving control assembly according to the present invention.

Referring to FIGS. from 1 through 3, a paper currency receiving control assembly in accordance with the present invention is shown comprised of a currency box 1, a casing 2, two locating plates 3, and a control unit 4.

The currency box 1 comprises two front flanges 11 vertically disposed at two opposite sides of the front opening thereof, two retainer elements 12 respectively outwardly extended from two opposite lateral sidewalls thereof, a retaining hole 14 formed in the back sidewall thereof near the bottom, a hinged bottom cover 13, the hinged bottom cover 13 having a hooked portion 131 disposed at the free end thereof and adapted for hooking in the retaining hole 14, a plurality of spring members, for example, conical springs 15 mounted on the inside surface of the back sidewall, and a movable pressure board 16 supported on the conical springs 15 and forced by the conical springs 15 against the front flanges 11. The casing 2 is covered on the front side of the currency box 1, defining a holding chamber 21, which holds a motor mount 23 and a motor 22 at the motor mount 23. The motor 22 has an eccentric plate 221 coupled to the output shaft thereof. An impression cylinder and sheet-transfer cylinder assembly 24 is mounted on the topside of the casing 2, and adapted to deliver paper currency to the holding chamber 21. The locating plates 3 are bilaterally coupled between the casing 2 and the currency box 1, each comprising a mounting portion 31 fastened to the casing 2, and a substantially L-shaped locating notch 32 coupled to one retainer element 12 of the currency box 1. The control unit 4 comprises a holder frame 41 fixedly mounted on the top side of the currency box 1, a control circuit board 42 mounted in the holder frame 41, the control circuit board 42 comprising a first solenoid switch 421 and a second solenoid switch 422, a first magnetic member 43 fixedly mounted on the top side of the currency box 1, and a second magnetic member 44 fixedly mounted the top side of the pressure board 16.

The assembly process of the present invention is outlined hereinafter with reference to FIGS. from 1 through 3 again. The conical springs 15 are respectively fixedly mounted on the inside surface of the back sidewall of the currency box 1, and then the first magnetic member 43 and the second magnetic member 44 are respectively fastened to the top sidewall of the currency box 1 and the pressure board 16, and then the pressure board 16 is put inside the currency box 1 and fastened to the spring members 5, and then the motor mount 23 is fixedly mounted in the holding chamber 21 of the casing 2 to hold the motor 22 inside the holding chamber 21, and then the holder frame 41 of the control unit 4 is fastened to the top side of the currency box 1, and then the locating plates 3 are fastened to the casing 2 and coupled to the retainer elements 12 to secure the casing 2 to the currency box 1. The aforesaid currency box 1, spring members 15 and pressure board 16 form a paper currency receiving unit. The aforesaid casing 2, impression cylinder and sheet-transfer cylinder assembly 24, motor mount 23, eccentric plate 221 and motor 22 form a paper currency delivery unit.

Figure 5:
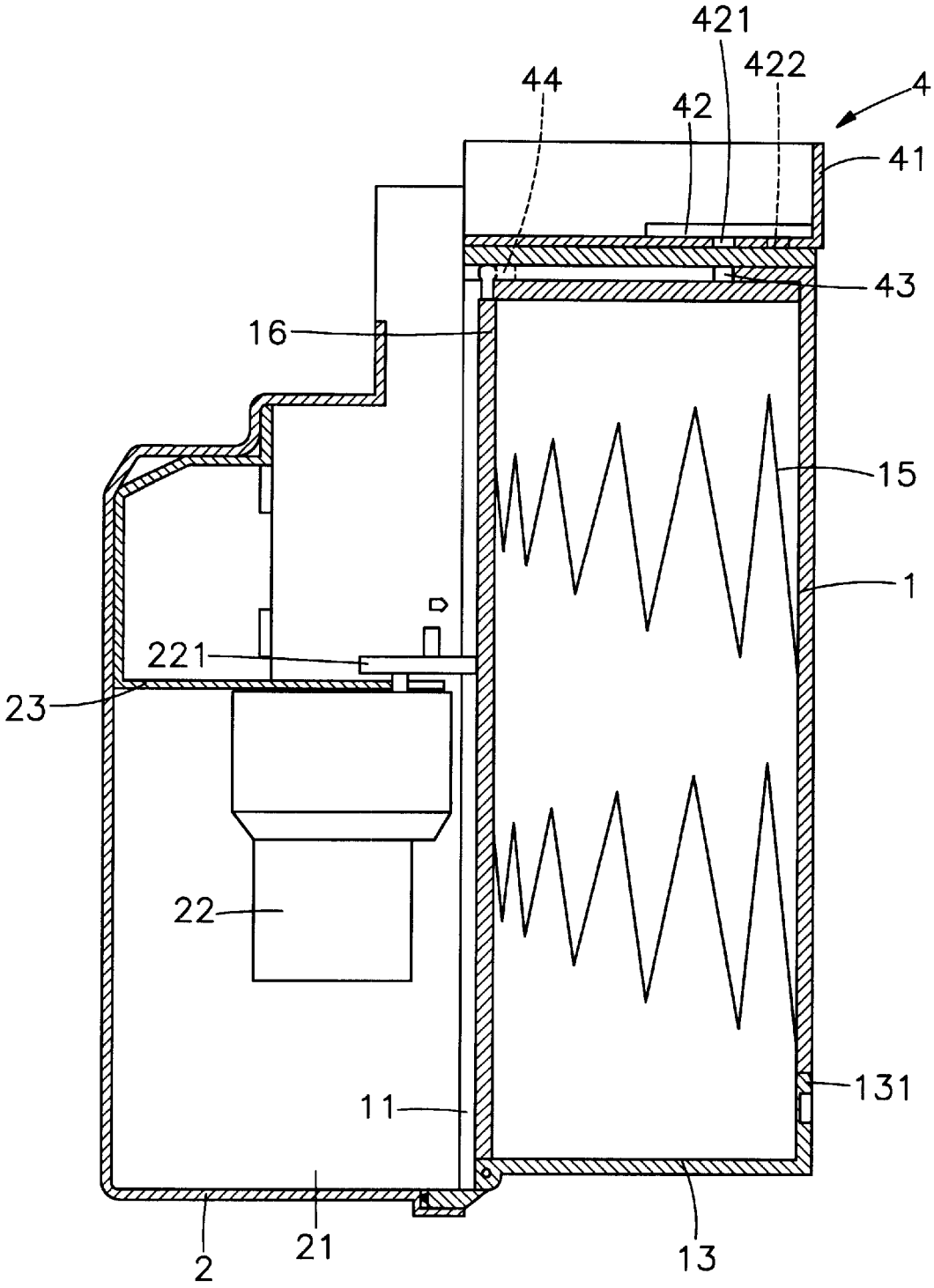
FIG. 5 is similar to FIG. 4 but showing the eccentric plate pressed on the inserted paper currency at the pressure board.
Figure 6:
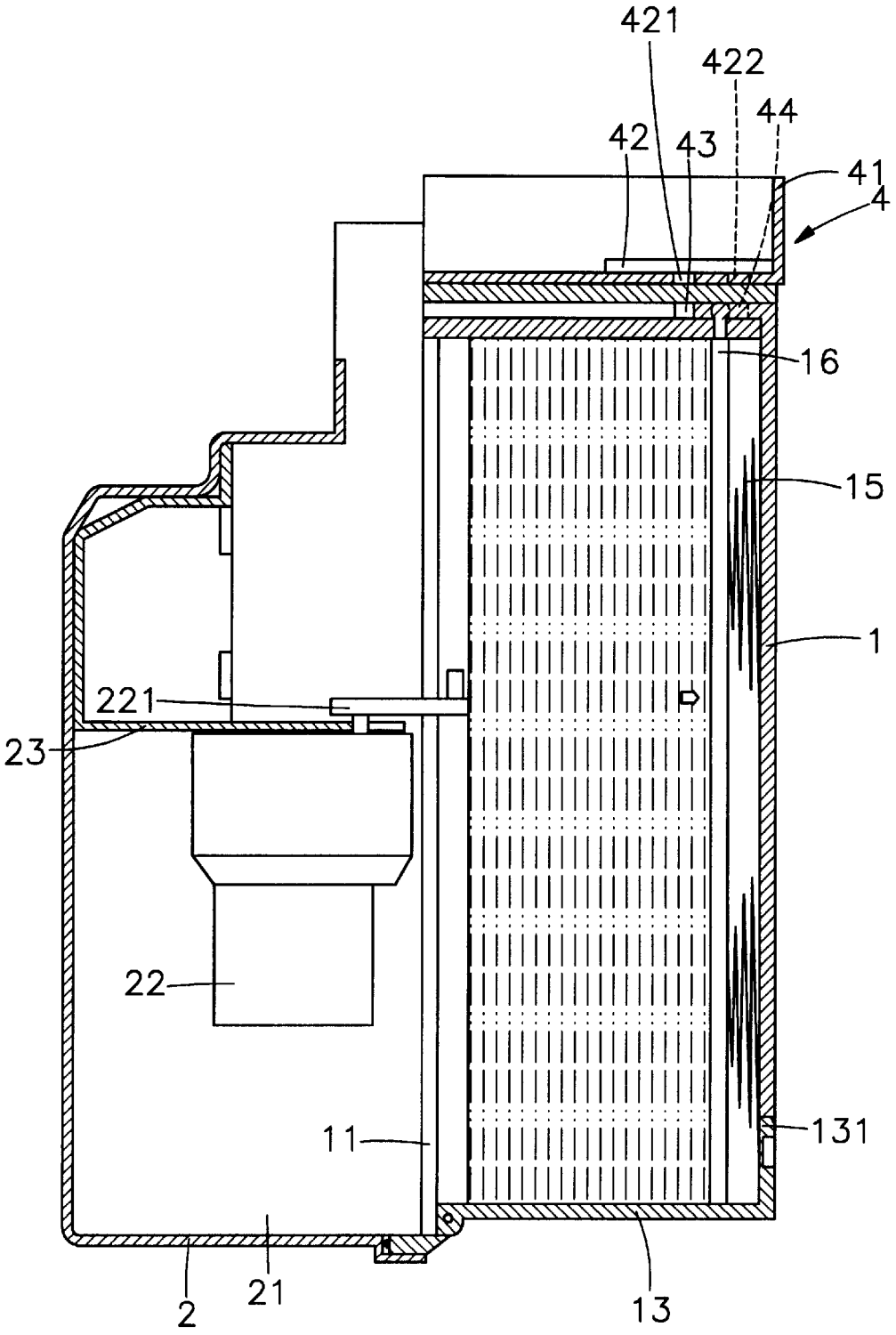
FIG. 6 is another sectional side view of the present invention, showing a stack of paper currency received in the currency box, the second magnetic member moved with the pressure board into alignment with the second solenoid switch.

Referring to FIGS. from 4 through 6, before connection of the casing 2 to the currency box 1, the control circuit board 42 of the control unit 4 is off. After the casing 2 had been fastened to the currency box 1, the first magnetic member 43 induces the first solenoid switch 421 to turn on the control circuit board 42. When a paper currency is inserted into the currency slot of the currency-coin exchanging machine, a currency detecting circuit (not shown) is induced to turn on the motor 22. When the impression cylinder and sheet-transfer cylinder assembly 24 delivers the inserted paper currency to the holding chamber 21, the eccentric plate 221 is turned with the output shaft of the motor 22 to press the delivered paper currency pressure on the pressure board 16 (see FIG. 5). When the currency box 1 is fully filled up with the paper currency, the second magnetic member 44 is moved with the pressure board 16 into vertical alignment with the second solenoid switch 422 (see FIG. 6), causing the coin changing machine to cut off power supply from the control circuit board 42, and to turn on an alarm lamp. Thereafter, the user can then open the hinged bottom cover 13, and then pick up the accumulated paper currency.

While only one embodiment of the present invention has been shown and described, it will be understood that various modifications and changes could be made thereunto without departing from the spirit and scope of the invention disclosed.

What the invention claimed is:

1. A paper currency receiving control assembly for currency-coin exchanging machine comprising a paper currency receiving unit adapted to receive paper money, a paper currency delivery unit adapted to delivery paper money to said paper currency receiving unit, and a control unit adapted to control the operation of said paper currency delivery unit, said paper currency receiving unit comprises a currency box, said currency box comprising a front opening, a back sidewall, two front flanges disposed at two sides of said front opening, spring means mounted an inside surface of said back sidewall, and a pressure board supported on said spring means and movable in said currency box between a first position close to said front flange of said currency box and a second position close to said back sidewall of said currency box and adapted to bear paper money being delivered from said paper currency delivery unit, wherein said control unit comprises a control circuit board adapted to control the operation of said paper currency delivery unit, a first solenoid switch adapted to turn on said control circuit board, a second solenoid switch adapted to turn off said control circuit board, a first magnetic member mounted on said currency box, which drives said first solenoid switch to turn on said control circuit board, and a second magnetic member mounted on said pressure board, which drives said second solenoid switch to turn off said control circuit board after said pressure board had been moved to said second position.

2. The paper currency receiving control assembly of claim 1 wherein said spring means comprises at least one conical spring.

3. The paper currency receiving control assembly of claim 1 wherein said paper currency delivery unit comprises a casing, and two locating plates mounted on two opposite sides of said casing and adapted to secure said casing to the front opening of said currency box.

4. The paper currency receiving control assembly of claim 3 wherein said currency box comprises two retainer elements disposed at two opposite lateral sides thereof, and said locating plates of said paper currency delivery unit each comprise a substantially L-shaped locating notch respectively coupled to the retainer elements of said currency box.

5. The paper currency receiving control assembly of claim 1 wherein said currency box comprises a hinged bottom cover.

6. The paper currency receiving control assembly of claim 1 wherein said control unit further comprises a holder frame, which holds said control circuit board on said current box.

7. The paper currency receiving control assembly of claim 3 wherein said paper currency delivery unit further comprises an impression cylinder and sheet-transfer cylinder assembly mounted on said casing adapted to deliver an inserted paper currency to said pressure board in said currency box.

8. The paper currency receiving control assembly of claim 7 wherein said paper currency delivery unit further comprises a motor mount mounted inside said casing, a motor mounted on said motor mount inside said casing and controlled by said control circuit board, and an eccentric plate coupled to said motor and driven by said motor to press the paper currency being delivered from said impression cylinder and sheet-transfer cylinder assembly on said pressure board.

* * * * *